United States Patent [19]

Williams

[11] 4,086,741

[45] May 2, 1978

[54] IMPACT UNDERCAP FILLER

[75] Inventor: Robert L. Williams, Davenport, Iowa

[73] Assignee: The Kartridg Pak Co., Davenport, Iowa

[21] Appl. No.: 752,414

[22] Filed: Dec. 20, 1976

[51] Int. Cl.[2] ..... B65B 31/00

[52] U.S. Cl. ..... 53/12; 53/22 R; 53/88; 53/112 R

[58] Field of Search ..... 53/7, 12, 22 R, 88, 53/112 R

[56] References Cited

U.S. PATENT DOCUMENTS

| | | | |
|---|---|---|---|
| 3,152,429 | 10/1964 | Stanley et al. | 53/88 |
| 3,977,151 | 8/1976 | Reever et al. | 53/88 X |

*Primary Examiner*—Travis S. McGehee

*Attorney, Agent, or Firm*—Lockwood, Dewey, Zickert & Alex

[57] ABSTRACT

Undercap filler machine and method for cyclically vacuumizing product-containing, conventional spray can type aerosol containers, charging metered quantities of compressed gas propellant thereinto, and crimping valve cap assemblies thereon. By means of sequencing spring action on the crimper head, the machine and method provide (1) accurate control of the cap lift against relatively low sequencing spring force during charging with compressed propellant gas and (2) firm cap seating under relatively high sequencing spring force on the bead of the container opening against the internal pressure therein during crimping. The controlled cap lift during charging introduces a temporary throttling restriction in the form of a predetermined narrow annular orifice between the fill chamber of the crimper head and the interior of each container which orifice produces a controlled drop in the impact gassing pressure and increased velocity of gas flow into the container. The hose transmitting metered charges of compressed gas propellant from each metering head to each crimper head is without restriction and of a charge transmitting capacity not substantially exceeding the maximum charge to be transmitted so as to minimize gas loss after filling.

7 Claims, 13 Drawing Figures

VACUUM

CAP ENGAGEMENT

PRESSURE FILL

CRIMPING

IMPACT UNDERCAP FILLER

This invention, relates, generally, to new and useful improvements in so-called undercap fillers and undercap filling methods wherein the primary functions and steps comprise, first vacuumizing the interiors of aerosol containers already partially filled with a desired quantity of product, second, charging a metered quantity of a compressed gas propellant into each product-containing aerosol container, and third, crimping the cap of a valve cap assembly in place on the bead of the opening in the top of each container without permitting escape of compressed propellant gas.

Heretofore, it has been a widespread practice to use fluorocarbon propellants in aerosol packages or spray cans of many products such as insecticides, paints, coatings, hair sprays, deoderants, etc. However, the use of fluorocarbons has been questioned thereby creating an increased demand for replacement with alternative propellants including, prominently soluable compressed gases such as carbon dioxide and nitrous oxide. By use of a technique called "saturation" a relatively large quantity of compressed gas can be dissolved into certain solvents to increase the volumetric ratio of gas to liquid well beyond that achieved by simply pressurizing the head space of the container. The present invention allows this process of saturation to be effected at high speed on the undercap filler by a process called "impact gassing" wherein saturation is achieved by injecting compressed gas into liquid at high rates to achieve turbulence and resultant increased liquid surface area.

The substitution of compressed gases for fluorocarbons as propellants is complicated by a basic difference in the physical properties of these two types of propellants. Thus, portions of the fluorocarbon propellant charges remain in the liquid stage in aerosol containers after the charges have partially vaporized creating adequate, but safe, propellant pressure under normal ambient conditions. Accordingly, as long as the containers have been properly vacuumized, a small excess of fluorocarbon propellant in a charge creates no problem since it will simply remain in the liquid phase until it is allowed to vaporize as the contents of the aerosol container are discharged. On the other hand, compressed gas propellants such as carbon dioxide and nitrous oxide do not assume the liquid state under normal ambient conditions but remain as gases up to pressures far exceeding these which can be safely withstood by commercial type aerosol containers such as spray cans. Accordingly, it is critical that charges of compressed propellant gases be introduced into aerosol containers with considerable accuracy since in the event a charge is short or less than required, there will not be enough propellant to empty the product or contents from the spray can. On the other hand, if there is an over-charge of compressed gas propellant, the excess pressure within the spray can may overstrain or even rupture the container.

Undercap fillers and undercap filling methods of the general type to which the present invention relates are disclosed in U.S. Pat. No. 2,963,834, dated Dec. 13, 1960 and 3,157,974, dated Nov. 24, 1964. A substantial number of undercap fillers of the type disclosed in these patents are in commercial use. These undercap fillers are widely utilized in introducing charges of fluorocarbon and hydrocarbon type propellants into spray can type aerosol containers. While it is understood that certain operators of these undercap fillers have been able to adapt them for "impact gassing" spray cans with compressed gas-type propellants such as carbon dioxide, this practice is not widespread and not readily achieved by most operators.

In accordance with the present invention, by making certain changes in the undercap fillers and methods of undercap filling of the type disclosed in the above-mentioned patents, such undercap fillers and filling methods can be converted for the safe, efficient and economical charging of conventional spray can type aerosol containers with compressed gas propellants of the type represented by carbon dioxide and nitrous oxide. One of the important changes made in this convession is the provision of a second set of pressure pad springs on the so-called crimper head of an undercap filler. The resulting sequencing spring action of the two sets of springs provides a lower force for controlling cap lift from a container opening during the charging or impact gassing stage or step and a higher spring force during the cap-crimping phase or step. Heretofore, sequencing springs have been utilized to a limited extent in undercap fillers and undercap filling operations but only for a substantially different purpose, namely, to permit a longer cap lift period and consequently a longer than normal filling time for more accurate charging of spray can containers with liquified propellants.

A further aspect of the conversion of known undercap fillers of the type disclosed in U.S. Pat. No. 3,157,974 and in commercial use is the elimination of the check valves and relatively large capacity pressure hoses interconnecting the fill chambers of the crimper heads with the metering chambers of the so-called metering heads and substitution therefor of high pressure hoses each having a charge transmitting capacity equal to or slightly greater than that required to transfer the maximum charge of compressed gas propellant from the metering heads to the crimper heads so as to minimize gas loss after filling.

Still another aspect of the conversion of known undercap fillers of the type described and shown in U.S. Pat. No. 3,157,974 for handling compressed gas type propellants is the equipping of the fill chamber of each crimper heads with a pressure-relief valve which serves not only to prevent compressed gas propellants from being introduced into a spray head or aerosol container at an excessively elevated pressure, but also provides an audible indication to the operator of the existence of an excess pressure condition.

It will be apparent from the following description that the foregoing changes in known type undercap fillers of the type described result in substantial improvements therein when used for impact gassing with compressed propellant gases.

In view of the foregoing, it will be seen that the object of the present invention, generally stated, is the provision of undercap fillers and undercap filling methods which are adapted for use in safely charging aerosol containers of the conventional spray can type on a commercial production basis with accurately metered quantities of compressed gas propellants such as carbon dioxide and nitrous oxide.

A primary object of the invention is to provide an undercap filler and undercap filling method which will achieve saturation of a maximum mass of compressed gas propellant into the product in a conventional aerosol spray can at maximum speed (i.e. in a minimum time) while operating at filling pressures low enough to permit use of a safety relief valve which allows normal production rate filling but which, if necessary, functions at a filling chamber pressure below that which would result in a container pressure which would burst or damage the container.

A further important object of the invention is a practical and economical means of converting existing undercap fillers of the type described that are already in use and of modifying the design of those to be newly built, so as to accommodate the safe and efficient use therein of compressed gas type propellants in place of fluorocarbon or hydrocarbon type propellants.

Certain other objects of the invention will be obvious or apparent from the following detailed description of the invention taken in conjunction with the accompanying drawing wherein.

The construction and operation of the undercap filler machine shown and illustrated in connection with FIGS. 1-9 corresponds generally to the construction and operation of the rotary undercap filler machine and the mode of operation thereof described and illustrated in the above-mentioned U.S. Pat. No. 3,157,974, dated Nov. 24, 1964. In fact, the present invention may be regarded as an improvement in the apparatus and method disclosed and illustrated in patent 3,157,974 and the disclosure thereof is accordingly incorporated by reference herein. The present invention may also be regarded as an improvement over the commercially available Kartridg Pak undercap fillers.

In a production line for producing aerosol packages there will usually be a main conveyor line in which there will be situated a product filler wherein empty aerosol containers or spray can receive a predetermined quantity of the product being filled (e.g. paint, insecticide, hair spray, etc.), a valve cap and dip tube assembly placer for loosely inserting such assemblies into the product containing spray cans, and a propellant charging or filler machine which functions to first vacuumize the freeboard or head spaces in the product-containing spray cans, second, introduce a metered quantity of propellant into each can, and third, crimp the valve cap in place on the bead of the top opening in each container. If desired, a leak detector apparatus may be located in the conveyor line following the propellant charging or filler apparatus. The present invention relates only to the propellant charging or filler apparatus and its method of operation.

Figure 1:
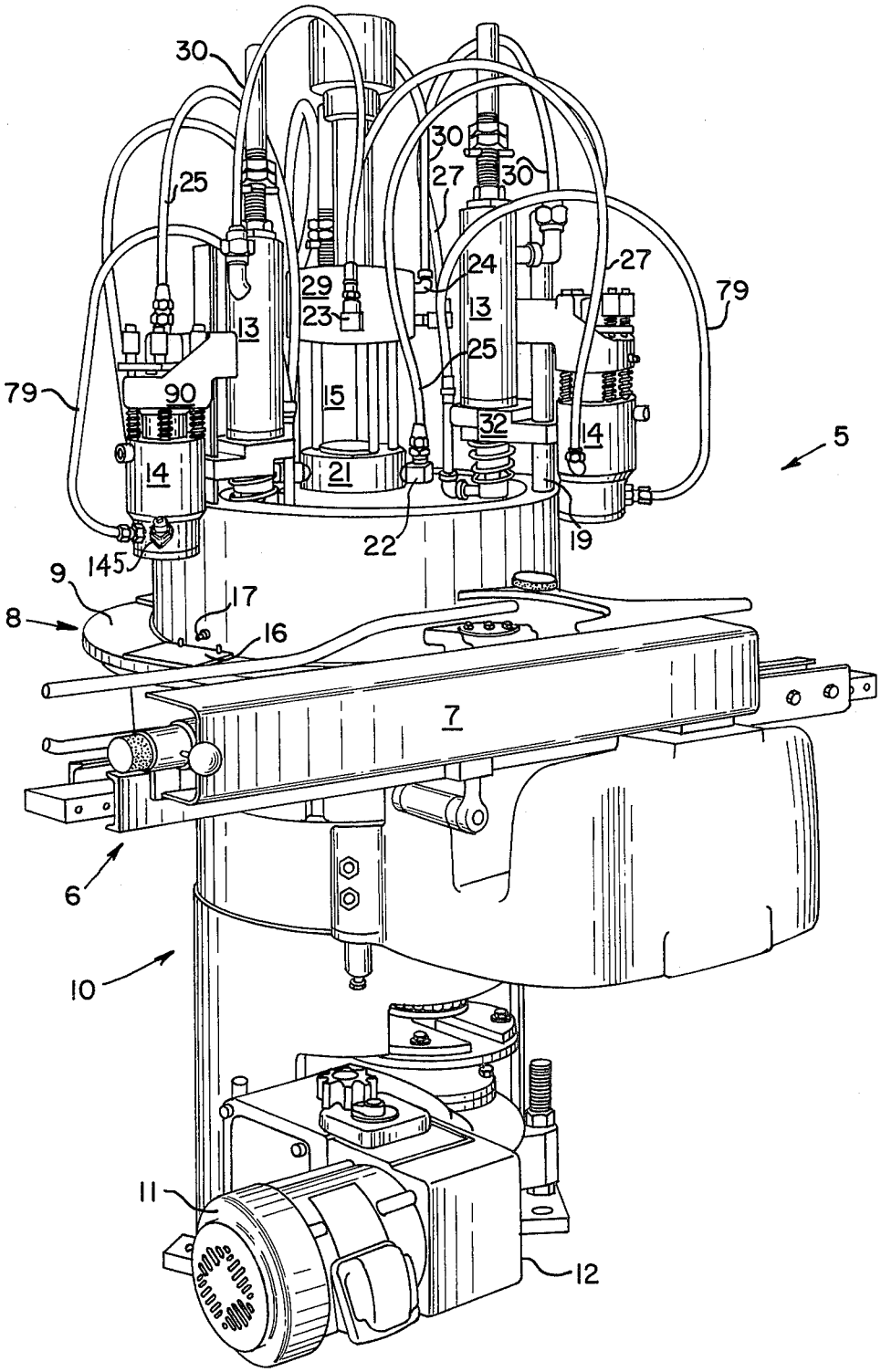
FIG. 1 is a perspective view of a so-called rotary type undercap filler in which the present invention is embodied and by means of which it may be practiced.

In FIG. 1 a rotary type undercap propellant charging or filler machine is indicated generally at 5 located in a spray can conveyor line indicated generally at 6. The conveyor line 6 is interrupted by a worm-type container feeding and removal unit of known construction indicated generally at 7. The machine 5 includes a turntable sub-assembly indicated generally at 8 on which the spray cans are supported while passing through the machine. The containers enter the machine from the left-hand side and discharge from the right-hand side as viewed in FIG. 1.

It will be understood that the filler 5 includes suitable stationary frame and mounting means including a base indicated generally at 10. The moving mechanical parts of the filler 5 are driven in known manner by means of an electric motor 11 coupled to a gear box 12.

On the super structure of the filler 5 shown in FIG. 1 there are six sets of metering heads and crimping heads indicated generally at 13 and 14, respectively. However, it will be understood that the present invention is useful with undercap fillers having for example 1, 3, 6, 9, 12, or 18 sets of metering and crimping heads. Each of the metering heads is supplied with compressed propellant gas from a central distributor assembly indicated generally at 15.

In the over-all operation of the propellant filler or charger machine 5 a spray can that has already received its charge or fill of product and has had a valve cap and dip tube assembly placed loosely thereon is positioned on the rotary dial 9 of the turntable 8 under one of the crimper heads 14. As the turntable 8 and dial 9 rotate and the sets of metering heads 13 and crimper heads 14 rotate therewith, each crimper head 14 in turn will first be lowered into bell-cap type seating relationship with the container thereunder and then will follow, in sequence, a vacuumizing step, a propellant charging or impact gassing step and a cap crimping step. After this sequence, each crimper head will be raised and thereafter the product-filled and propellant-charged spray can or aerosol package will be discharged from the undercap filler 5.

Figure 9:
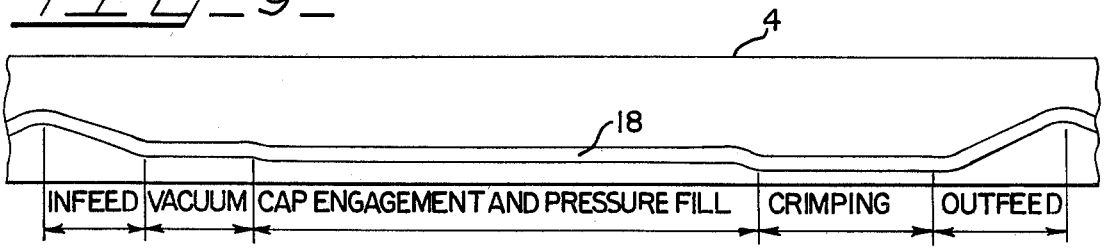
FIG. 9 is a timing chart showing the several segments of the cam track groove in the stationary cylindrical cam of the undercap filler shown in FIG. 1.

Beneath the turntable 8 there is located a cylindrical cam 4 (FIG. 9) provided with a single endless cam track or groove 18 (FIG. 9). (A similar cylindrical cam is indicated at 32 in FIG. 3 of U.S. Pat. No. 3,157,974 but having upper and lower endless cam tracks or grooves therein designated at 33 and 34, respectively.) Each set comprising a metering head 13 and a crimper head 14 is provided with a vertically reciprocable operating post 19 (FIGS. 1 and 2), the lower end of which carries a cam follower 20 which operates in the cam track 18 (FIG. 9).

Each spray can A with its content of product and its valve cap and dip tube assembly resting in place is delivered by the conveyor 6 onto one of the support plates 16 carried by the dial 9 on the turntable 8. A container sensing rod 17 (FIGS. 1 and 3) is associated with each of the plates 16 having one end projecting over the dial so as to be engaged and pressed inwardly by a container A.

Figure 10:
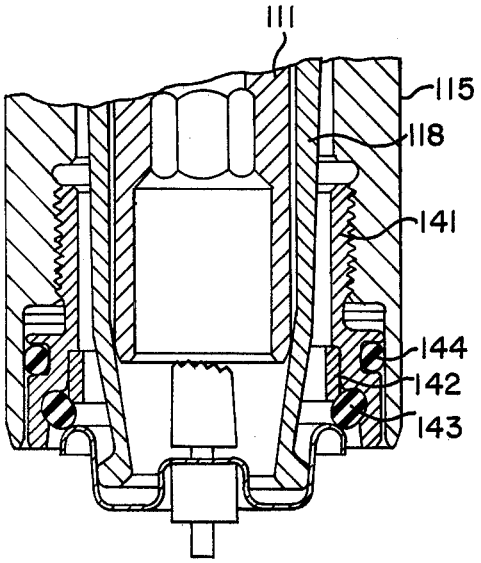
FIG. 10 is a detail vertical sectional view on enlarged scale showing a valve cup engaging the cap seal.
Figure 7:
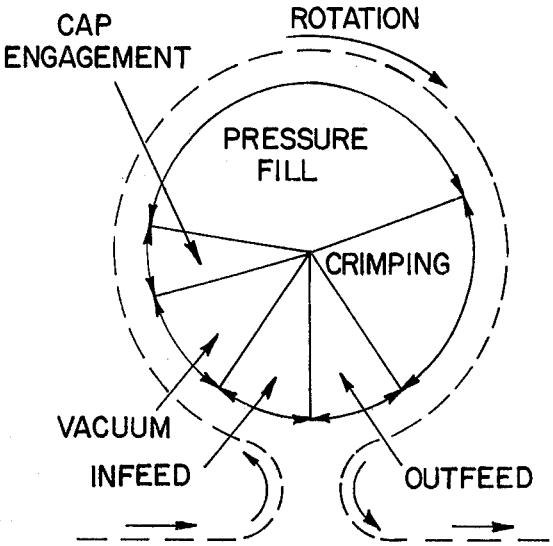
FIG. 7 is a diagrammatic illustration of the container flow path and processing sequence embodied in the undercap filler and method of filling associated with the apparatus of FIG. 1.
Figure 8A:
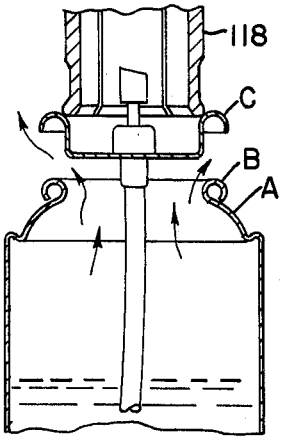
FIGS. 8A, 8B, 8C and 8D are diagrammatic views illustrating various steps or operations performed by the apparatus of FIG. 1 in charging aerosol containers with compressed propellant gas.
Figure 8B:
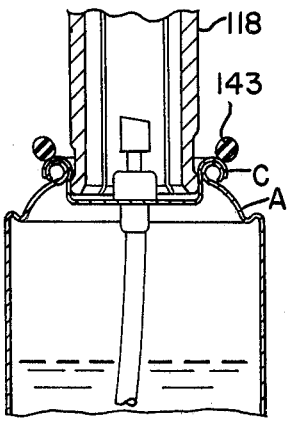
Figure 8C:
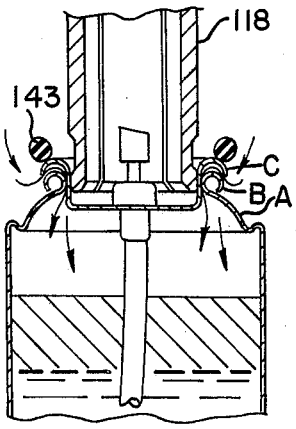

The sequence of operations performed by each of the crimper heads 14 on a spray can or aerosol container as it travels with the turntable 8 from the infeed to the outfeed position is depected in FIGS. 7, 8A–D and 9. First, there is a container infeed phase during which the cam follower 20 on the lower end of each post 19 associated with a crimper head 14 travels through the infeed portion of the cam track or groove 18 (FIG. 9). When a cam follower 20 reaches the lower end of the infeed section, the crimper head 14 will have seated it self on the upper annular shoulder of the spray can as will be described in more detail in connection with FIG. 4. The second phase or step in the sequence of operations is for vacuum to be applied from within the interior of the crimper head 14 which serves to lift the valve cap dip tube assembly so that the valve cap C is raised from the bead B defining the opening in the top of the spray container A and allows air or other volatile materials in the head space or freeboard space above the product to be removed. It will be noted from FIG. 8A that during evacuation the cap C is lifted upwardly against the lower end of a collet indicated generally at 21. After vacuumizing has been completed, the cap C drops back into place on the bead B after which it is engaged by the cap seal gasket 143 as shown in FIG. 8B and FIG. 10. The next step or phase of the sequence is the introduction of compressed propellant gas under impacting pressure into the head space or freeboard space of the container A. The impact pressure is such as to act on the underside of the valve cap C and cap seal 143 and raise or lift the valve cap C and contacting spring-loaded members against the relatively light pressure exerted by one set of sequencing springs as will be described in detail in connection with FIGS. 4–6. This creates a restricted annular metering orifice through which compessed gas propellant is introduced into the spray can as illustrated in FIG. 8C. When the pressure fill or impact gassing phase is completed, the crimper head operates to cause the collet 21 to firmly seat the cap C in place on the bead B of its associated container (FIG. 8D) and crimp the same in place so as to form a hermetic seal between the cap and the bead. The final phase is for the crimper head control cam follower 20 to rise in the outfeed portion of the cam track 18 thereby lifting the crimper head 14 sufficiently above the filled and charged container A so as to permit the same to be transferred through the outfeed onto the discharge side of the worm unit 7.

The compressed propellant gas distributor assembly 15 (FIG. 1) includes a hub 21 which rotates with and as part of the turntable assembly. The details of construction of the central distributor sub-assembly 15 do not form a part of the present invention and may conform to the details of construction of the corresponding sub-asembly shown and described in U.S. Pat. No. 3,157,974. The hub 21 of the sub-assembly 15 carries six hydraulic liquid pressure connections 22-22 while the head 29 carries six vacuum connections 23-23 and six compressed propellant gas delivery connections 24-24. Each of the pressureized hydraulic fluid connections 22 has a hydraulic pressure line 25 connected therewith which connects at its opposite end with a threaded inlet 26 (FIG. 4) at the top end of an associated crimper head 14. Each of the vacuum connections 23 has a vacuum line 27 connected at one end thereto with the opposite end of each line 27 being connected with the vacuum connection or inlet 28 (FIG. 4) of an associated crimper head. Each of the pressurized compressed propellant gas discharge connections 24 is connected by a pressure hose 30 to an inlet connection 31 (FIG. 3) of an associated metering head 13. During operation of the filler 5, each of the pressurized hydraulic fluid connections 22 is supplied with hydraulic fluid under pressure, each of the vacuum connections 23 is maintained under vacuum and each of the pressurized propellant gas delivery connections 24 is supplied with compressed propellant gas under suitable pressure.

The manner in which each of the metering heads 13 is constructed and operates so as to deliver metered quantities of compressed propellant gas under relatively high pressure at appropriate intervals to an associated crimper head 14 will now be described. Each metering head 13 is adjustably mounted on an associated vertically reciprocating operating post 19 (FIGS. 1 and 2) by means of a mounting bracket 32 having a circular opening for receiving the intermediate stepped portion of a threaded plug 33 the upper end of which is screwed into the lower internally threaded end of an outer cylindrical sleeve 34. A split retainer ring 35 partially seated within a groove in the exterior of the plug 33 serves to retain the metering head 13 in the mounting bracket 32 for vertically reciprocating movement with the operating post 19. The metering head 13 is actuated when it is sufficiently lowered so that a poppet end knob 36 engages a pedestal which is normally held up at a predetermined height by means of a compression spring 38. When a spray can is in place so as to cause the inner end 40 of a rod 17 to be located underneath the bottom end of the vertical stem of the pedestal 37, it thereby prevents the pedestal from being depressed by the descending knob 36. It will be seen that if there is no can in place, then the compression spring 41 will serve to shift the rod 17 outwardly (i.e. to the left as viewed in FIG. 3) thereby removing the end 40 from underneath of the stem of the pedestal 37 and allowing the pedestal to be depressed when engaged by the descending poppet end 36.

The upper end of the outer cylinder sleeve 34 is also threaded to receive therein an upper closure plug 42. Within the outer cylinder sleeve 34 and between the lower and upper plugs 33 and 42 an inner cylinder sleeve 43 is concentrically positioned in annularly spaced relation with sleeve 34. The inner sleeve 43 at its upper end engages a formation 39 integrally formed on the underside of the upper plug 42 which provides a plurality of openings 44-44 which establish continuous communication between the annular space 45 and the upper end of the cylinder chamber. A retainer disc 46 is located between the upper end of the lower closure plug 33 and the lower end of the inner cylinder sleeve 43. The retainer disc 46 has a counterbored central port 47 providing for flow of compressed gas propellant into and out of the lower end of the inner cylinder sleeve or liner 43. Periodic communication between the lower portion of the annular space 45 and the interior of the liner 43 is provided by a plurality of openings 48-48 located at the upper end of the closure plug 33.

A piston 50 including an annular seal 51 has fluidtight sliding movement in the cylinder unit 43. An externally threaded adapter 52 is screwed into the center well in the piston 50 and projects above the top of the piston so as to be provided with a lock nut 53 for clamping a ring cap 54 to te piston 50 with the seal 51 secured in place therebetween. The coupling element 52 also serves to anchor the lower end of a piston rod 55 to the piston assembly 50. The piston rod 55 passes upwardly through an axial opening in the upper closure plug 42 the intermediate counterbore of which carries in an imtermediate portion a seal ring packing 56. The upper portion of the bore within the upper plug 42 is internally threaded so as to receive the lower end of a threaded guide tube 57 which projects a substantial height above the upper plug 42. The guide tube 57 has diametrically opposed vertical slots 58 therein extending for most of its intermediate height so as to accommodate the opposite ends of a stop pin 59 carried by a cap 60 screwed on the upper end of the piston rod 55. A pair of hex nuts 61 and 62 are screwed onto the upper part of the guide tube 57 and normally tightened together in jammed or locking relationship. It will be seen that by locating the nuts 61 and 62 at different positions the height to which the piston 50 is permitted to rise within the inner cylinder sleeve or liner 43 is determined. It is by this adjustment that the size of the metering chamber M within the liner 43 is set at the desired volume.

A valve cage 63 is housed within the lower plug 33 and is provided at its upper end with an O-ring seal 64 around the vertical opening 65 therein. In operation the O-ring 64 has periodic sealing engagement against an annular valve seat 66 integrally formed on the underside of the seal or closure disc 46.

A vertically reciprocable valve stem 67 provided with a head formation 68 at its upper end is slidable within a packing nut 70 in the lower end of the plug 33 and an upper packing nut 71 screwed into the lower end of the valve cage 63. The upper end of the bore within the valve stem 67 terminates underneath the head 68 whereat radial openings 72-72 are provided to communicate between the upper end of the passageway or bore and the interior of the valve cage 63. The lower end of the valve stem 67 is threaded and screwed into an internally threaded neck 73 integrally formed on the upper end of the poppet knob 36. The lower end of the passageway or bore in the valve stem 67 communicates with a vertical bore 74 in the knob 36 which in turn communicates with the inner end of a laterally extending port 75. The latter is internally threaded so as to receive a threaded adapter 76 to which one end of an associated flexible hose 79 is connected. A coil compression spring 77 within the valve cage 63 is seated at its lower end on the enlarged valve stem head 68 and at its upper end on the underside of the upper wall of the valve cage and over a locating annular flange 78. The spring 77 normally urges the valve stem head 68 downwardly into sealing engagement with an O-ring 80 seated in the upper end of the bore in the packing nut 71, thereby blocking premature discharge of compressed propellant gas from the metering chamber M.

A compression spring 81 is seated at its bottom end on a flanged washer 82 fitting over the neck 73 and resting on the top of the knob 36 and its upper end engages the lowermost shoulder on the bottom plug 33. The spring 81 serves to normally maintain the valve cage 63 and the associated parts in their lower or retracted position (as shown in FIG. 3) within the lower end of the lower plug 33.

The cycle and manner of operation of the metering head 13 during each cycle of operation of its associated crimper head 14 may now be described in connection with FIG. 3. With the components of the metering head 13 in the condition shown in FIG. 3 the metering chamber M is filled with compressed gas propellant such as carbon dioxide under a pressure in the order of 400 to 450 psig. The compressed gas propellant also fills the annular space 45 surrounding the inner sleeve 43. The valve stem 67 being in its lowermost position, the discharge passageway or bore therethrough is sealed by the O-ring seal 80 which is compressed between its seat and the annular valve seat surface on the underside of the head 68 on the valve stem 67. It will be seen that both ends of the cylinder sleeve or liner 43 are in communication with the compressed gas propellant which is in continuously open supply communication through the inlet connection 31 and the pressure tube or hose connection 30 connected therewith. Accordingly, the pressure of the compressed gas propellant acts on both the upper and lower sides of the piston assembly 50. However, there is a differential in the forces acting on the upper and lower sides of the piston assembly 50 since the area against which the pressure acts on the upper face or side is reduced by the presence of the piston rod 55. The difference in area results in an excess force on the underside of the piston 50 in the order of about 22 pounds. This force maintains the piston 50 in the upper most position that is permitted by the engagement of the stop pin 59 with the nut 62.

When the metering head 13 descends sufficiently on the downward stroke of the post 19, the bottom of the poppet knob 36 will engage the top of pedestal 37 thereby arresting the downward movement of the knob end 36 and the valve stem 67 carried thereby. However, the remainder of the metering head assembly continues to descend with the post 19. In one embodiment of the apparatus the total downward (and upward) movement of the metering head is 3.570 inches with the downward movement thereof after the poppet knob 36 engages the pedestal 37 being 0.500 inch. When the downward movement of the poppet knob 36 and valve stem 67 are arrested, the strength of the coil spring 77 is sufficient so that it urges the valve cage 63 upwardly so as to produce a seal between the O-ring 64 and the annular valve seat boss 66 on the underside of the disc 46. When this seal is formed, the communication is shut off between the port 47 in the disc 46 and the annular space 45. Before the metering head 13 reaches the nadir of its downward movement, the valve stem head 68 becomes unseated from the O-ring 80 thereby establishing communication between the bore of the valve stem and the metering chamber M. Since the pressure on the underside of the piston 50 is now less than the full pressure of the compressed gas propellant which is maintained on the upper side thereof, the piston 50 will descend until its bottom face engages the top face of the disc 46 thereby expelling the metered contents of the chamber M through the flexible hose 79 into the fill chamber of the crimper head 14.

Figure 3:
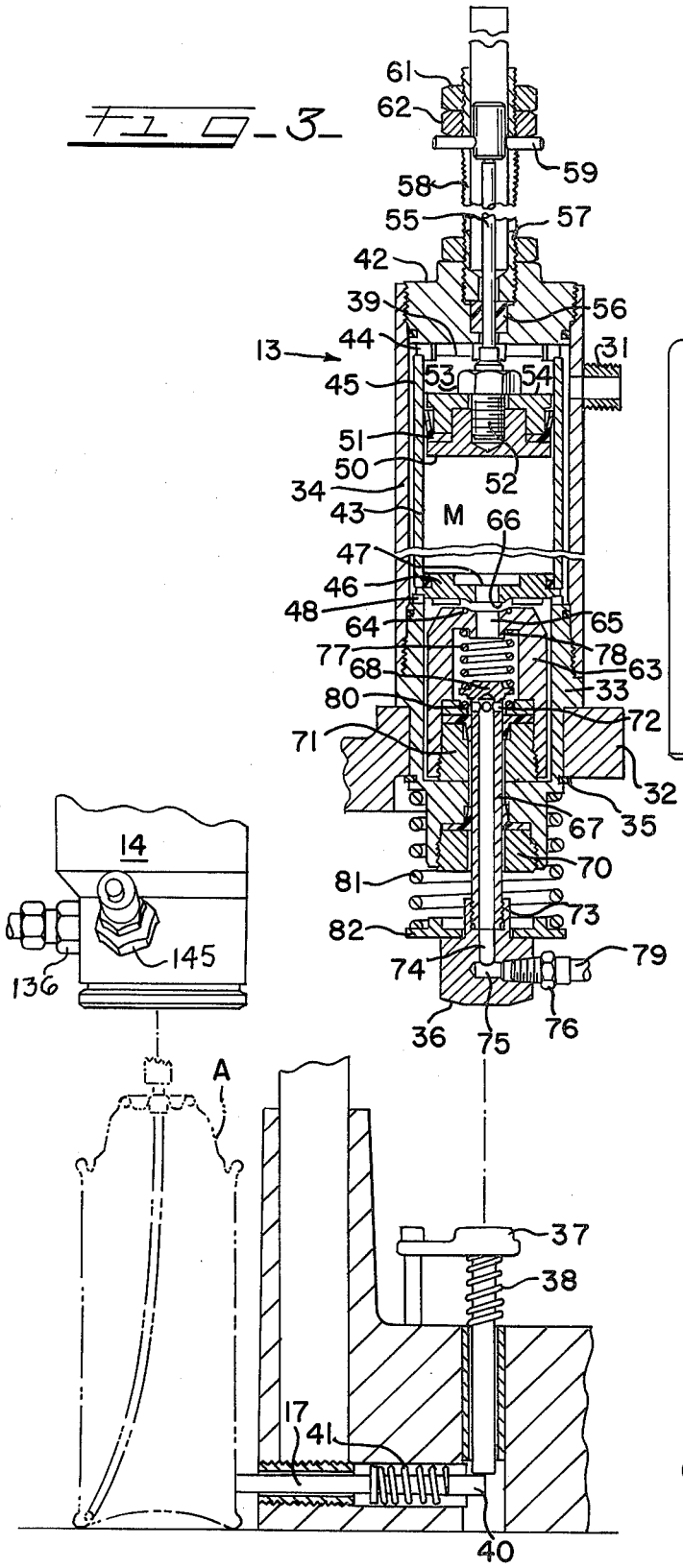
FIG. 3 is a vertical sectional view through one of the metering heads and showing the metering head and, in fragmentary side elevation, the lower end of its associated crimper head in their fully-raised position with respect to a spray can to be charged with compressed gas propellant.
Figure 6:
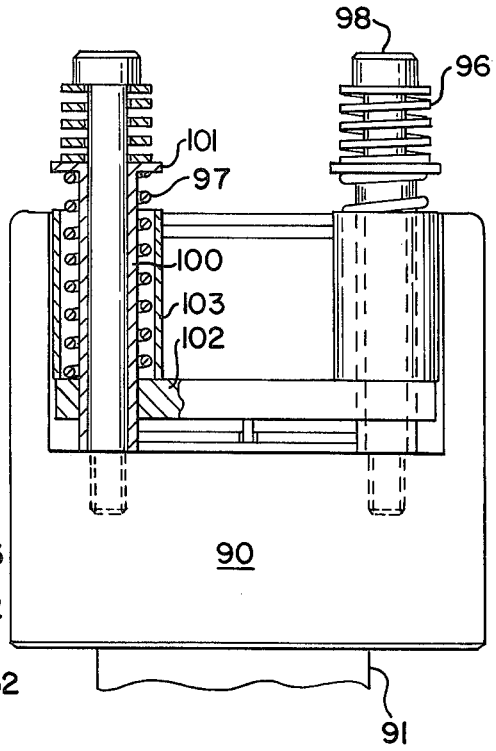
FIG. 6 is an elevational view, partly in section, taken generally on lines 6—6 of FIG. 5.
Figure 5:
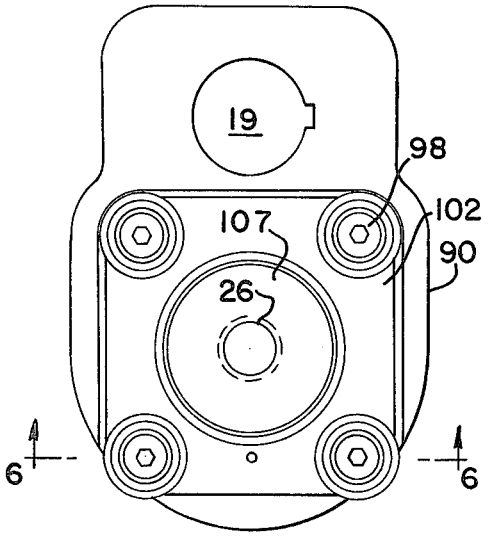
FIG. 5 is a top plan view of one of the crimper heads taken on line 5—5 of FIG. 2.

It will be seen that upon upward movement of the post 19 and simultaneous upward movement of the metering head 13 the parts or components of the metering head are allowed to resume their normal positions and relationship with respect to each other as shown in FIG. 3. In this connection it will be seen that after the seal between the underside of the valve stem head 68 and the O-ring 80 is re-established and te seal between the O-ring 48 and te annular surface 66 is broken, compressed gas propellant is once again allowed to flow from the bottom of the annular space 45 through the ports or openings 48 and into the metering chamber M. As mentioned above, the differential in the force exerted by the compressed gas propellant on the underside of the piston 50 with respect to the upper surface thereof elevates the piston 50 and allows the metering chamber M to be refilled with compressed gas propellant in the proper amount which is achieved when the stop pin 59 engages the bottom jam nut 62.

Figure 4:
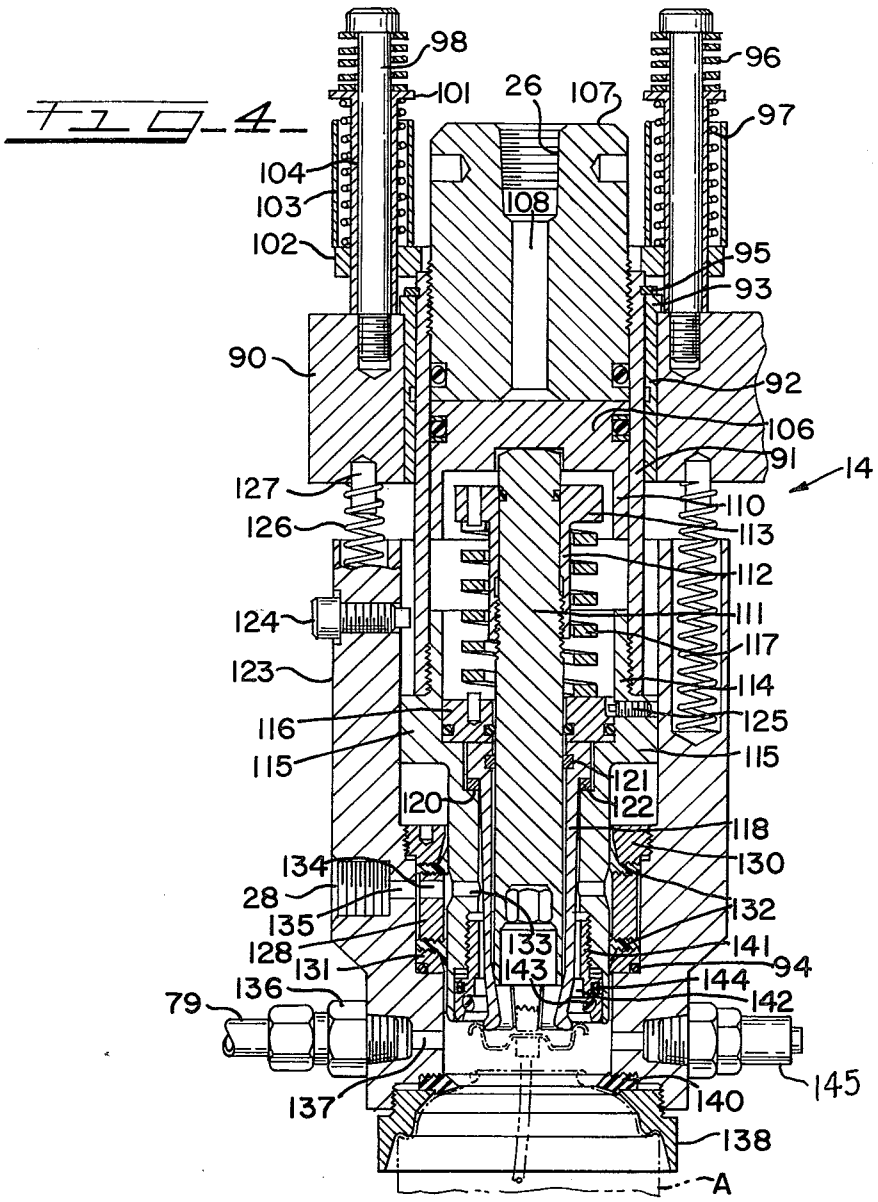
FIG. 4 is a vertical sectional view through one of the crimper heads.
Figure 2:
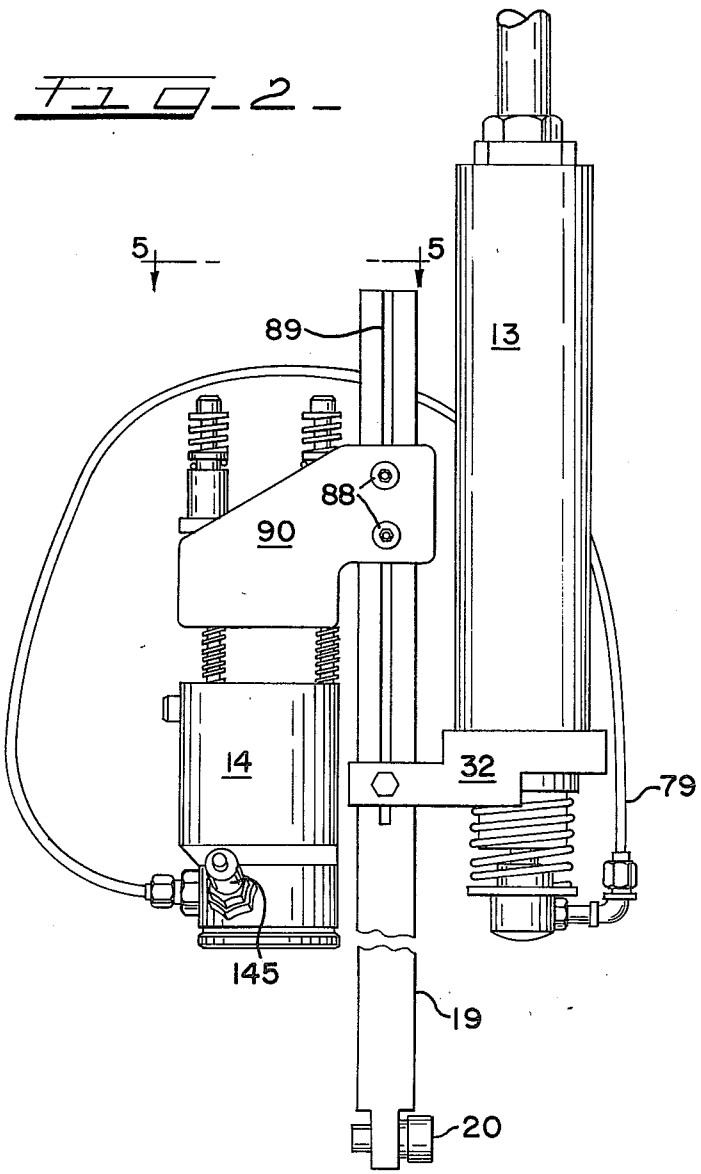
FIG. 2 is an elevational view showing one of the sets of so-called metering and crimping heads with which the undercap filler of FIG. 1 is equipped.

For a description of the construction and operation of the crimper head 14 reference may now be had particularly to FIGS. 4–10. Referring to FIGS. 2 and 4, it will be seen that the crimper head 14 is supported from the vertically reciprocating post 19 by means of a mounting bracket 90 which is vertically adjustable on the post 19 by means of a pair of set screws 88 the inner ends of which engage a vertical key 89 on the post. The key 89 serves to properly orient the mounting brackets 90 and 32 on the post 19 and thereby the crimper head 14 and metering head 13, respectively. The crimper head 14 has a cylindrical sleeve 91 which is internally threaded at its upper and lower ends and which fits slidably within a bushing 92 press-fitted in the opening in the support bracket 90. The bushing 92 is provided at its upper end with a circumferential shoulder 93 whereby it is supported on the top of the bracket 90. It will be seen that the cylindrical sleeve 91 is vertically reciprocal in the bushing 92 and is provided adjacent its upper end with a lock ring 95 which prevents it from falling through the bushing 92.

The sleeve 91 and the various parts carried thereby is restrained from lifting by means of two sets of sequencing springs with one set comprising four upper stiffer springs 96 and the other set four weaker springs 97. The upper springs 96 fit over the upper ends of four corner posts in the form of headed bolts 98-98. The lower set of sequencing springs 97 surround bushings 100 each of which is provided at the top with a flange 101. The bushings 100 fit over the bolts or posts 98 the threaded lower ends of which are screwed into the top of the mounting bracket 90. The lower ends of the bushings 100 rest on top of the bracket 90 and are retained in this position by means of the upper set of sequencing springs 96 the bottom ends of which rest on the respective flanges 101 while the upper ends press upwardly against the undersides of the heads of the bolts 98. The lower set of sequencing springs 97 are compressed between the underside of the flanges 101 at their upper ends and a preload ring 102 the underside of which bears downwardly against the upper end of the cylinder 91.

Each of the lower and weaker preloading sequencing springs 97 is surrounded by a sleeve 103 which is shorter than the fixed distance between the underside of each flange 101 and the upper side of the preload ring 102. Since the lower sequencing springs 97 are weaker than the upper set 98, it is possible for the preload ring 102 together with the cylinder 92 to rise upwardly solely against the force of the springs 97 until these springs are compressed sufficiently so that the sleeves 103 have physical engagement underneath each of the flanges 101. When this engagement occurs, the lower sequencing springs 97 cannot be compressed any more and then the upper and stiffer sequencing springs 96 resist any further upward movement of the sleeve 91. The purpose of having the two sets of sequencing springs with one set 97-97 being weaker than the second set 96-96 will be explained in more detail below.

A free piston 106 is disposed within the main cylinder sleeve 91 for actuation by hydraulic liquid pressure delivered into the inlet 26 by means of one of the hydraulic fluid pressure lines 25. The inlet 26 in the end casting 107 leads into a vertical axial bore 108 extending completely therethrough. The floating or free piston 106 has a depending cylindrical skirt 110 which provides a recess for the upper end of a plunger assembly comprising a main plunger element 111 which is exteriorly threaded intermediate its ends so as to receive in threaded relationship thereon the depending interiorly threaded sleeve portion 112 of a plunger adjusting member 113. The lower end of the cylinder 91 has screwed thereinto the upstanding exteriorly threaded collar portion 114 of an inner bell member 115.

A plunger sealing ring 116 is slidably disposed within the collar 114 and is provided with interior and exterior O-ring seals for providing sealing relationship with the interior of the collar 114 and the exterior of the plunger 113, respectively. A helical plunger return spring 117 encircles the sleeve 112 and plunger 111 with its upper end bearing on the underside of the head of the plunger adjusting member 113 and its lower end bearing against the upperside of the plunger seal ring 116.

A collet assembly 118 fits telescopically over the lower end of the plunger member 111 with the enlarged upper end of the collet assembly 118 fitting in the annular space between the underside of the plunger seal ring 116 and an internal shoulder 120 formed on the interior of the inner bell 115. An inner seal ring 121 embraces the plunger 111 while an outer seal ring 122 embraces the collet segments underneath the enlarged upper end thereof. The lower end of the plunger 111 is hollow and serves to spread or distend the lower ends of the collet segments when the plunger is moved downwardly relative to the collet assembly 118. It is this distending or spreading action which serves to crimp each cap C of a valve cap assembly in place on the bead B of each container A.

An outer bell 123 slidably embraces the large diameter portion of the inner bell 115 and is of sufficient vertical length so as to embrace the lower portion of the cylinder 91 and also depend or extend a substantial distance below the lower end of the collet assembly 118. The outer bell 123 carries a bell stop 124 in the form of a headed screw with the inner end thereof protruding into the annular space between the interior of the upper portion of the bell 123 and the exterior of the lower portion of the cylinder 91 so as to engage the top of the enlarged portion of the inner bell 115 and prevent the outer bell from falling off. In similar manner a stop 125 maintains the plunger seal ring 116 in place.

Four equi-spaced outer bell springs 126-126 are provided which fit over locating pins 127-127 in between the upper end of the outer bell 123 and the underside of the support bracket 90. These springs 126 normally urge the outer bell toward its lowermost position relative to the main cylinder 91 and inner bell 115. Thus, when the crimper head 14 is freely suspended, the inner end of the stop 124 rests on the enlarged portion of the inner bell 115 and the lower end of the outer bell 123 hangs substantially beneath the lower end of the collet assembly 118. As shown in FIG. 4, the outer bell 123 is in a partially raised position which is brought about by the presence of a container A in supporting relationship underneath the crimper head 14.

In the annular space between the interior of the outer bell 123 and the exterior of the lower portion of the inner bell 115 several rings located including a seal spacer ring 128, a seal ring nut 130, a bottom seal ring 131. A pair of gasket rings 132-132 are located on top of and beneath the seal spacer ring 128. Desirably, an O-ring 94 is placed underneath the bottom seal ring 131.

By tightening the seal ring 130 down in the threaded bore on the interior of the outer bell 123 the seals 132 are maintained in effective sealing relationship between the interior of the outer bell 123 and the exterior of the inner bell 115.

The lower end portion of the inner bell 115 is provided with a series of radial passageways 133-133 which in FIG. 4 are shown to be in level alignment with a passageway 134 in the seal spacer ring 128. The passageway 134 in turn is aligned with the passageway 135 in the outer bell 123 into which the threaded inlet opening 28 communicates.

The lower end portion of the outer bell 123 also has an interiorly threaded side port for receiving a threaded fitting 136 to which is connected one end of one of the propellant transmitting lines 79. This interiorly threaded bore communicates with an inner passageway 137 into the interior of the outer bell adjacent its lower end.

At its bottom end the outer bell is counterbored and interiorly threaded so as to receive in threaded relationship an interiorly contoured container engaging adapter ring 138. An annular container engaging seal gasket 140 is secured in place between the adapter ring 138 and the bottom end of the outer bell 123 as shown. The seal ring 140 provides a gas tight seal between the interior of the outer bell 123 and an upper shoulder portion of a container A when the crimper head 14 is lowered down onto the container.

A cap seal holder 141 (FIG. 10) having an exteriorly threaded upper portion is screwed into the interiorly threaded lower end of the inner bell 115. The lower portion of the holder has an annular groove on the interior which with the assistance of a retainer ring 142 serves to retain a cap seal gasket 143. An O-ring 144 located in an exterior groove on the cap seal holder 141 provides a seal between the holder and the inner bell 115.

The operation of the crimper head 14 will be described commencing with the crimper head in its highest position at the beginning of the "infeed" portion of the cam track 18 (FIG. 9). When the crimper head 14 is in this position, the outer bell 123 will be in its lowest position with respect to the inner bell 115 with the inner end of the bell stop screw 124 engaging the top of enlarged head portion of the inner bell. The cam follower 20 riding in the cam groove 18 causes the supporting post 19 to lower during the infeed portion of the cycle and at the end thereof which coincides with the beginning of the vacuum portion of the crimper head 14 will typically have been lowered 2.820 inches and adapter ring 138 will have seated onto the upper crown of the container A with the seal ring gasket 140 being compressed in sealing engagement against the upper portion of the dome surrounding the bead B of the container. The downward movement of the outer bell 123 is arrested when such engagement with the container A is obtained.

At the beginning of the vacuum portion of the cycle the cam follower 20 will have brought the inner bell 115 and the outer bell 123 into the relative relationship that is shown in FIG. 4 with the vacuum ports 133, 134 and 135 in the inner bell, bottom seal spacer ring 128 and the outer bell 135, respectively, being aligned horizontally whereby vacuum maintained in line 27 is applied to the interior of the lower portion of the inner bell and thence into the head space of the container A. The vacuum is sufficiently strong so as to lift the valve cap C upwardly against the slightly distended lower end of the collet 21 (FIG. 8A) which interengagement serves to prevent the cap C from rising further. The vacuum dwell is sufficient to remove air and other non-condensable gaseous materials from the head space or freeboard space within the container A. At the end of the vacuum dwell the cam follower 20 causes the inner bell 115 to lower still further (e.g. 0.500 of an inch) against the foce of springs 126 until the cap seal gasket 143 engages the cap C against the can bead B as illustrated in FIGS. 8B and 10. In this condition of "cap engagement" the valve cap C is resting on the bead B of the container A and the cap seal gasket 143 engages the outer top margin of the cap curl. The timing of the operation of the metering head 13 is such that when this condition of cap engagement is achieved, the metering head 14 operates as described above to deliver a charge of compressed gas propellant from the metering chamber M directly through the interconnecting hose 79 into the fitting 136 and through the port 137 into the lower end of the outer bell 123. Since the curl on the valve cap C has sealing engagement with the cap seal gasket 143, the impact pressure of the gaseous propellant acts on the underside of the valve cap C and lifts the cap off its seat on the bead B against the resistance offered by the weaker sequencing springs 97-97. The predetermined amount that the valve cap C is allowed to lift from the container B is very small in the order of 0.030 of an inch thereby providing a controlled annular throttling orifice permitting the charge of compressed propellant gas to enter into the head space of the container A. The controlled bottoming of the upper ends of the sleeves 103 surrounding the weaker sequencing springs 97 against the undersides of the flanges 101 determines the size of the annular throttling orifice as described above. This relationship is illustrated in FIG. 8C. Typically, the maximum pressure of the charge of compressed $CO_2$ gas propellant within the fill chamber of the crimper head 14 will be in the order of 230 to 250 pounds per square inch gauge and this will be throttled or reduced on passing through the annular orifice down to an impact pressure on the contents in the container of from 120 to 160 pounds per square inch. The pressure fill phase typically takes about ½ of a second which is sufficient for a charge weighing in the order of from 4–14 grams to be delivered into the container depending on several factors including the volume of the head space and the Ostwald factor of the product solvent.

By accurately controlling the size of the annular throttling orifice on a production-run repetitive basis it is feasible to optimize both the flow rate of the compressed gas propellant charge and the velocity so as to achieve optimum agitation of the product. Such agitation results in a maximum increase of product surface area which translates into rapid saturation and minimized pressure within the container. It is highly important that internal container pressures be minimized in order to provide a maximum margin between filling pressure and can-distortion pressure and permit use of a relief valve.

If the pressure in the container during or after filling is higher than desired, pressure relief valve 145 will be forced open at a preset pressure. Typically, the pressure relief valve is set to relieve at a filling chamber pressure which will result in a container pressure below the distortion pressure of the container, allowing normal filling without loss through the pressure relief valve, while protecting against possibly hazardous over-pressurization of the container.

Figure 8D:
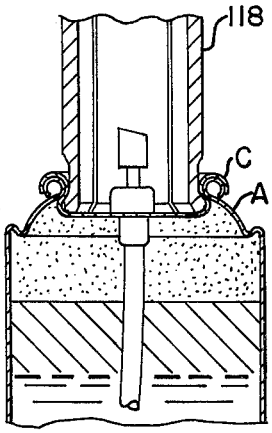

At the end of the cap engagement/pressure fill dwell the post 89 and mounting bracket 90 will be lowered still further in the order of 0.250 inch to their lowermost position (FIG. 8D). Since the lower weaker set of sequencing springs 97 will have been compressed sufficiently so that the flanges 101 will have bottomed on the sleeves 103 the final lowering of the inner bell 115 will be assisted by the strong spring action of the upper and stronger set of sequencing springs 96. The springs 96 will be strong snough to firmly seat the valve cap C on the bead B against the pressure of the propellant gas within the head space and container during the crimping action.

I claim:

1. In an undercap filler having at least one crimper head-metering head combination which in operation (1) evacuates the head space above a product in an aerosol container with the cap of a valve cap dip tube assembly lifted off the annular bead of the container top opening, (2) charges propellant into the container through the top opening while the cap is lifted, and (3) crimps the cap in hermetically sealed relationship on the bead, the improvement which allows the filler to charge a compressed gas propellant into the container and which comprises: uninterrupted conduit means communicating directly between the propellant discharge port of the metering head and the propellant inlet port of the crimper head, a safety valve mounted on the crimper head in direct pressure responsive relationship with the fill chamber of the crimper head, a set of relatively weak pressure pad springs effective during charging of compressed gas propellant into the container to allow the cap to lift from the bead, stop means limiting the distance the pressure pad lifts against the hold-down resistance of the set of weak springs during propellant charging, and a set of relatively strong pressure pad springs effective only during crimping to seat and hold the cap in sealed relationship on the container bead during crimping.

2. The improvement called for in claim 1 wherein: and relatively strong pressure pad spring is superposed co-axially over a relatively weak pressure pad spring; a tubular bushing having a laterally extending flange on its upper end fits co-axially over each pressure pad spring retaining bolt with the lower end of each bushing engaging the crimper head support bracket; and, a sleeve co-axially surrounds each relatively weak spring with its lower end resting on the pressure pad and its upper end on lifting being engagable with the underside of the associated lateral flange; the lower end of each relatively strong spring engaging the top side of its associated lateral flange and the upper end of each relatively strong spring engaging the underside of the head on its associated bolt.

3. In the undercap method of charging compressed gas propellant by means of an undercap filler into an aerosol container containing a predetermined quantity of product while the cap of the valve cap dip tube assembly therefor is temporarily lifted from resting position on the bead of the container top opening, the improvement which comprises, delivering a metered charge of compressed gas propellant into said container through a restricted annular orifice of predetermined size created by allowing said cap to lift a predetermined distance against a charging hold-down force provided by a set of relatively weak springs, and immediately after charging crimping said cap to said bead while said cap is held down in sealing engagement with said bead by a crimping hold-down force substantially greater than said charging hold-down force and provided by a set of relatively strong springs.

4. The improvement called for in claim 3 wherein the compressed gas propellant is carbon dioxide and the pressure thereof is reduced from in the range of about 230 to about 250 psig to in the range of from about 120 to about 160 psig on passing through said restricted orifice.

5. The improvement called for in claim 3 wherein metered charge is delivered from the metering head of an undercap filler directly to the fill chamber of a crimper head of an undercap filler through a conduit without restrictions therein and having capacity not substantially exceeding the minimum required to deliver each metered charge so as to minimize gas loss after filling.

6. In the undercap method of charging compressed $CO_2$ gas propellant by means of an undercap filler into an aerosol container containing a predetermined quantity of product while the cap of the valve cap thereof is temporarily lifted from resting position on the bead of the container top opening so as to provide an annular throttling orifice, the improvement which comprises, controlling the size of said throttling orifice at a predetermined value during passage of a charge of compressed $CO_2$ propellant gas therethrough whereby (1) sufficient agitation of product is produced within the container to allow rapid saturation of the compressed gas propellant into the product and (2) the pressure across said throttling orifice drops from a charging pressure in the range of 230 to 250 psig to an impact pressure in the range of from 120 to 160.

7. In the undercap method of charging compressed gas propellant by means of an undercap filler into an aerosol container containing a predetermined quantity of product while the cap of the valve cap dip tube assembly therefor is temporarily lifted from resting position on the bead of the container top opening, the improvement which comprises, delivering a metered charge of compressed gas propellant into said container through a restricted annular orifice of predetermined size created by allowing said cap to lift a predetermined distance against the hold-down force provided by a set of relatively weak springs, and immediately after charging crimping said cap to said bead while said cap is held down in sealing engagement with said bead by the hold-down force provided by a set of relatively strong springs, any excess charging pressure being relieved through a pressure relief valve directly responsive to the pressure of the compressed gas propellant on the upstream side of said restricted orifice.

* * * * *